US012714227B2

(12) United States Patent
Miyasaka

(10) Patent No.: US 12,714,227 B2
(45) Date of Patent: Aug. 25, 2026

(54) CHAIR

(71) Applicant: OKAMURA CORPORATION, Yokohama (JP)

(72) Inventor: Nozomi Miyasaka, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 117 days.

(21) Appl. No.: 18/678,743

(22) Filed: May 30, 2024

(65) Prior Publication Data

US 2024/0423371 A1 Dec. 26, 2024

(30) Foreign Application Priority Data

Jun. 2, 2023 (JP) ..... 2023-091944

(51) Int. Cl.
*A47C 7/18* (2006.01)

(52) U.S. Cl.
CPC ..... *A47C 7/185* (2013.01)

(58) Field of Classification Search
CPC ..... A47C 7/185; A47C 27/121; A47C 27/148
USPC ..... 297/284.1, 284.4, 284.9, 284.11, 445.1, 297/451.11, 452.13, 452.21; 428/222
See application file for complete search history.

(56) References Cited

U.S. PATENT DOCUMENTS 5,639,543 A * 6/1997 Isoda ..... D04H 3/03 428/221
2014/0183914 A1* 7/2014 Cvek ..... A47C 7/02 297/284.1

FOREIGN PATENT DOCUMENTS

JP 2003289999 A 10/2003

* cited by examiner

*Primary Examiner* — Justin V Lewis
(74) *Attorney, Agent, or Firm* — NIXON PEABODY LLP; Jeffrey L. Costellia

(57) ABSTRACT

A chair includes a backrest, a seat and legs. The seat includes a cushion formed with a net-like structure made of a thermoplastic resin and having a thickness, a seat plate configured to support the cushion, and an outer covering configured to cover the cushion. An upper surface of the cushion includes a first place that has a first hardness and that is configured to support a sitting person's buttock, a second place that is located outside of the first place when seen in a plan view and that has a second hardness higher than the first hardness, and a third place that is located outside of the second place when seen in a plan view and that has a third hardness higher than the second hardness.

5 Claims, 8 Drawing Sheets

CHAIR

CROSS-REFERENCE TO RELATED APPLICATION

Priority is claimed on Japanese Patent Application No. 2023-091944, filed Jun. 2, 2023, the content of which is incorporated herein by reference.

BACKGROUND OF THE INVENTION

Field of the Invention

The present invention relates to a chair.

In the related art, there is a chair in which hardness changes according to a position of a seat (for example, see Japanese Unexamined Patent Application, First Publication No. 2003-289999). Japanese Unexamined Patent Application, First Publication No. 2003-289999 discloses a chair with good seating comfort, the chair having a seat using a cushioning material including a hard member part and a soft member part that is provided on at least a part of a pressure receiving area that receives a load from the body and that is softer than the hard member part.

SUMMARY OF THE INVENTION

Incidentally, in recent years, there has been a desire for office chairs to be manufactured using closed loop recyclable members that use resources almost permanently. However, in the chairs in the related art, urethane foam, which is a thermosetting resin, is used as a raw material for a cushioning material. For this reason, in the chairs in the related art, while waste matter from the cushioning material can be processed into chip urethane, which can be recycled as a material with limited uses or can be thermally recycled as fuel, the chairs cannot be closed loop recycled as the same product as before recycling. Accordingly, in the chairs in the related art, it is difficult to reuse the waste matter as a closed loop recycled material.

An aspect of the present invention provides a chair that is closed loop recyclable and has good seating comfort.

A chair according to a first aspect of the present invention is a chair including a backrest, a seat and legs, wherein the seat includes: a cushion formed with a net-like structure made of a thermoplastic resin; a seat plate configured to support the cushion; and an outer covering configured to cover the cushion, and wherein an upper surface of the cushion includes: a first place that has a first hardness and that is configured to support a sitting person's buttock; a second place that is located outside of the first place when seen in a plan view and that has a second hardness higher than the first hardness; and a third place that is located outside of the second place when seen in a plan view and that has a third hardness higher than the second hardness.

According to the first aspect, a sitting person's buttock sink deeper in the seat as they move inward when seen in a plan view and becomes a state such as enveloped. In this state, as a part of the sitting person's buttocks in which the sinking in to the cushion is shallower, it is supported by a place having higher hardness in the cushion. Accordingly, when sitting, the buttocks are less likely to slip outward, allowing the person to sit in a stable position. Accordingly, a chair with good seating comfort is obtained.

Further, since the cushion is formed with a net-like structure made of a thermoplastic resin, unlike the case in which the cushion is formed of urethane foam, waste matter of the cushion can be reused as a closed loop recycled material.

As described above, it is possible to provide a chair that is closed loop recyclable and has good seating comfort.

In addition, by forming the cushion with the net-like structure, air permeability can be easily secured, and the cushion made of the resin can also ensure ease of cleaning.

According to a chair of a second aspect of the present invention, in the chair according to the first aspect, the cushion may further include a forward place that is located in front of the first place and that has hardness equal to or lower than the first hardness.

According to the second aspect, since the forward place with which the sitting person's femoral regions come into contact is set to hardness equal to or lower than the first hardness, a part of the cushion with the lower hardness will abut against the sitting person's femoral regions. Accordingly, a feeling of pressure on the femoral regions can be reduced. Accordingly, seating comfort can be further improved.

According to a chair of a third aspect of the present invention, in the chair according to the first or second aspect, a distribution of hardness in the upper surface of the cushion may coincide with a distribution of hardness in a lower surface of the cushion when seen in an upward/downward direction.

According to the third aspect, a structure that exhibits the hardness of the cushion is provided to penetrate the cushion in the upward/downward direction. If the distribution of hardness changes depending on the depth position relative to the upper surface of the cushion, the seating comfort may change depending on the size of the area with which the sitting person's buttocks come into contact when they sink into the cushion. Accordingly, according to the third aspect, constant seating comfort is obtained regardless of the sitting person's body type, weight, or the like.

According to a chair of a fourth aspect of the present invention, in the chair according to any one of the first to third aspects, the cushion may include a pair of first regions that includes the first place and that have an interval on a center of the upper surface in a leftward/rightward direction; and a central region that is located between the pair of first regions and that includes a central portion of the upper surface in the leftward/rightward direction, and wherein hardness of the central region may be higher than the first hardness.

According to the fourth aspect, the first region, which has the first hardness, allows the buttocks to sink in and provide seating comfort, and the central region, which has a fourth hardness higher than the first hardness, can even more keep the buttocks in place and prevents them from slipping. Accordingly, seating comfort can be further improved. In addition, compared to the configuration in which the central portion of the cushion in the leftward/rightward direction has the first hardness, sagging of the cushion can be suppressed.

According to a chair of a fifth aspect of the present invention, in the chair according to any one of the first to fourth aspects, the cushion may have a convex portion that is disposed along an outer edge of the seat plate and that is engaged with the outer edge.

According to the fifth aspect, the convex portion engages with the outer edge of the seat plate, making it difficult for the cushion to slip relative to the seat plate. Accordingly, the cushion can be stably supported on the seat plate.

In addition, by interposing the convex portion between the outer covering and the outer edge of the seat plate, the outer covering abuts against the outer edge of the seat plate in a state having a tension at while having the convex portion therebetween, making the outer covering less likely to be damaged even if the outer edge of the seat plate has an angular shape.

Further, a worker can hook his/her fingers on the convex portion, making it easier for the worker to grasp the cushion.

According to the aspects of the present invention, it is possible to provide a chair that is closed loop recyclable and has good seating comfort.

DETAILED DESCRIPTION OF THE INVENTION

Hereinafter, embodiments of the present invention will be described with reference to the accompanying drawings. Further, in the following description, components having the same or similar functions are designated by the same reference signs. Overlapping descriptions of these components may be omitted. In addition, in the following description, directions of forward, rearward, upward, downward, leftward, rightward, and the like are the same as directions of a person who is sitting on a chair in a regular posture (a sitting person). That is, a direction in which the sitting person faces forward is referred to as "forward," and a direction opposite thereto is referred to as "rearward." Further, in each of the drawings, an arrow UP indicates upward, an arrow FR indicates forward, and an arrow LH indicates leftward.

First Embodiment

Figure 1:
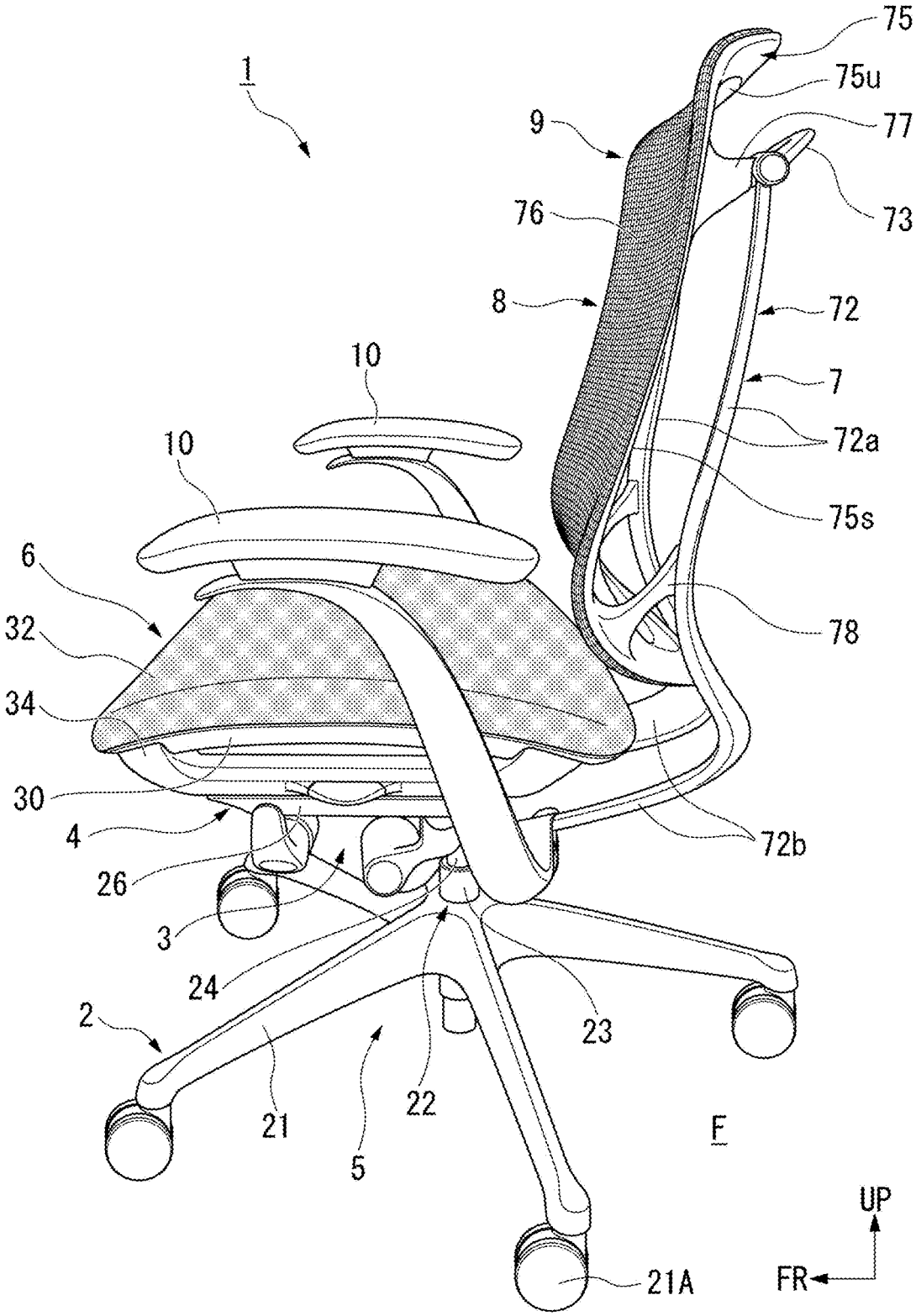
FIG. 1 is a perspective view of a chair according to a first embodiment from a side.
Figure 2:
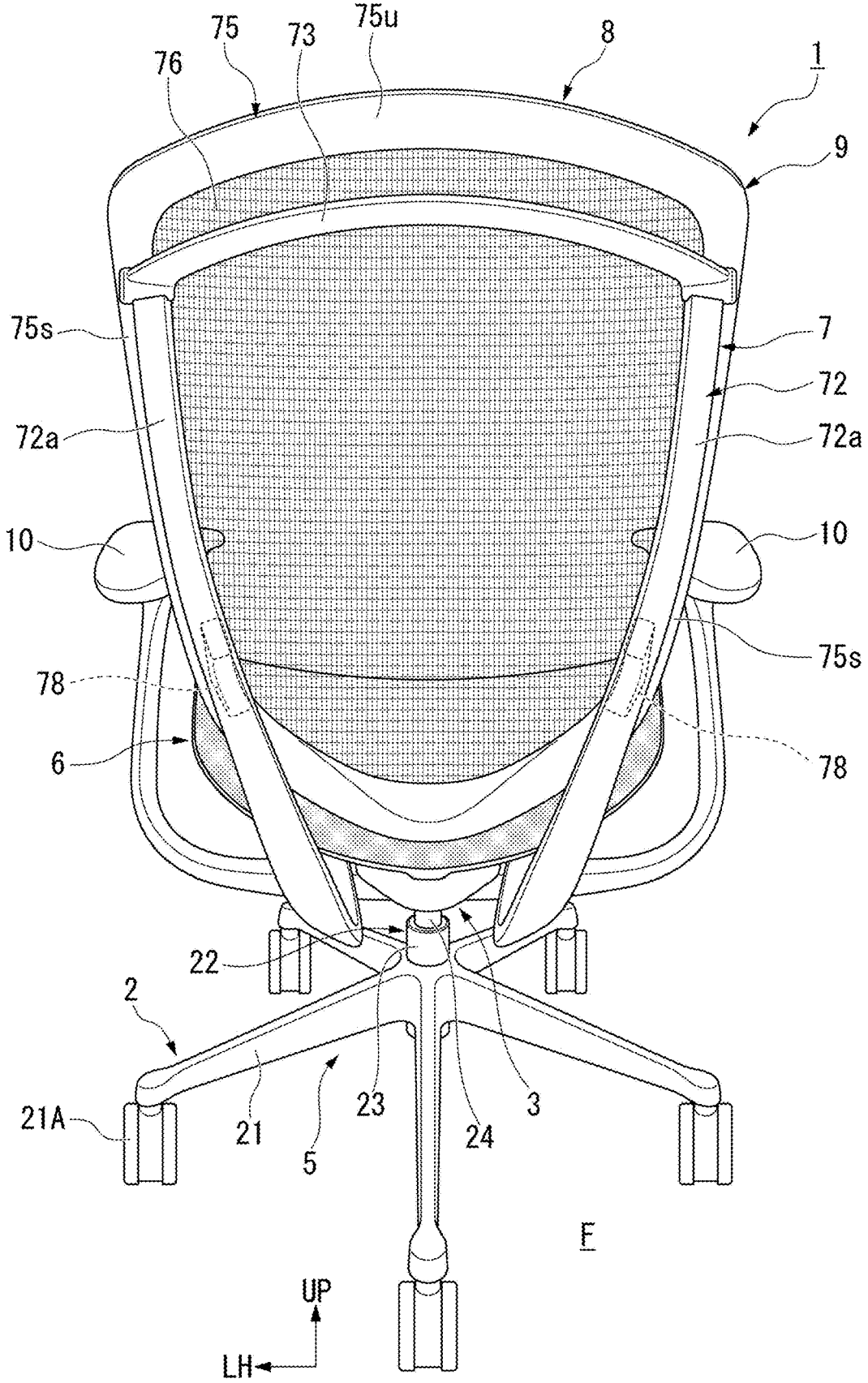
FIG. 2 is a perspective view of the chair according to the first embodiment from a rear side (a side of a backrest).

FIG. 1 is a perspective view showing a chair 1 according to a first embodiment from a side. FIG. 2 is a perspective view showing the chair 1 according to the first embodiment from a rear side (a side of a backrest).

As shown in FIG. 1 and FIG. 2, the chair 1 of the first embodiment includes legs 2 installed on a floor surface F, a box-shaped support base 3 installed on upper portions of the legs 2, a seat-receiving member 4 attached to an upper portion of the support base 3, a seat 6 supported on an upper portion of the seat-receiving member 4 to be position-adjustable in a forward/rearward direction, a backrest support body 7 that is substantially L-shaped when seen in a side view, pivoted on both left and right side portions of the support base 3 and tiltable by a reclining mechanism (not shown) in the support base 3, a backrest main body 8 attached to a front surface side of an upper portion of the backrest support body 7, and a pair of left and right armrests 10, on which elbows of a sitting person are placed, attached to a front edge of a lower portion of the backrest support body 7. The backrest support body 7 and the backrest main body 8 constitute a backrest 9 that supports a load of the back of the sitting person.

The legs 2 have grounding parts in contact with the floor surface F. The legs 2 extend from the grounding part toward the seat 6, and a sitting load is transferred from the seat 6 to the floor surface F. The legs 2 have multi-pronged legs 21 with casters 21A, and a leg column 22 that stands up from a central portion of the multi-pronged legs 21 and that contains a gas spring (not shown) that is a lifting mechanism.

The leg column 22 includes an outer tube 23 and an inner tube 24. The outer tube 23 configures a lower portion of the leg column 22. The outer tube 23 is non-rotatably fitted to and supported by the multi-pronged legs 21. The inner tube 24 configures an upper portion of the leg column 22. An upper end portion of the inner tube 24 fixes and supports the support base 3. A lower portion of the inner tube 24 is rotatably supported in the outer tube 23 in a horizontal direction.

A lifting adjustment mechanism of the leg column 22 and a reclining mechanism of the backrest 9 are installed in the support base 3.

The seat-receiving member 4 is swingably connected to an upper portion of the support base 3. The seat-receiving member 4 is designed to be displaced in the forward/rearward direction in conjunction with tilting movement of the backrest support body 7. The seat-receiving member 4 has a pair of left and right side frame portions 26. The left and right side frame portions 26 are disposed parallel to each other. A guide rail configured to swingably support the seat 6 in the forward/rearward direction protrudes from an upper portion of each of the left and right side frame portions 26. In the embodiment, the legs 2, the support base 3 and the seat-receiving member 4 constitute a support structure 5 configured to support the seat 6 from below.

The seat 6 supports a sitting person's body from the buttocks to the femoral regions. The seat 6 has a seat plate 30 (see FIG. 3) formed of a hard resin and configured to receive a sitting load, and a pair of frame-receiving portions 34 provided on a lower surface of the seat plate 30 at positions separated from each other in the leftward/rightward direction. The seat plate 30 is formed in a circular or rectangular shape when seen in a plan view such that a shape when seen in a plan view is substantially equal to a shape of the seat 6 when seen in a plan view. The left and right frame-receiving portions 34 are provided at positions corresponding to the left and right side frame portions 26 of the seat-receiving member 4, respectively, and extend in the forward/rearward direction. The frame-receiving portions 34 are formed to be longer in the forward/rearward direction than the guide rails of the side frame portions 26. The left and right frame-receiving portions 34 are configured as parts integrated with the seat plate 30. However, the frame-receiving portions 34 may be formed as parts separated from the seat plate 30, and may be fixed to the seat plate 30 by a fixing means. Details of the seat 6 will be described below.

A major part of the backrest support body 7 is formed of a metal material such as an aluminum alloy or the like. The backrest support body 7 includes a pair of left and right main frames 72 disposed separately in the leftward/rightward direction, and a connecting frame 73 extending in the leftward/rightward direction and connecting upper end portions of the main frames 72. The left and right main frames 72 each have a standing portion 72*a* formed in substantially an L shape when seen in a side view and standing upward from a position below a rear portion of the seat 6, and a forward-facing arm portion 72*b* curved from a lower end of the standing portion 72*a* and extending forward. A front end portion of the forward-facing arm portion 72*b* is coupled to a shaft of the reclining mechanism provided on the support base 3 as described above. In addition, the standing portions 72*a* of the left and right main frames 72 are inclined outward in the leftward/rightward direction so that the gap width between them gradually widens upward.

The backrest main body 8 supports the sitting person's back. The backrest main body 8 has a backrest frame 75 formed of a resin, and a covering member 76 stretched on the backrest frame 75 and configured to directly receive an input load from the sitting person's back. The backrest frame 75 is formed in an inverted triangular shape when seen from the front, with the gap width of left and right frame edges 75*s* gradually narrowing toward the downward side, and the upper end portions of the left and right frame edges 75*s* being connected by a frame edge 75*u* on the upper side extending in the leftward/rightward directions. An upper connecting arm 77 protruding rearward from a region near the upper portion and a lower connecting arm 78 protruding rearward from a region near the lower portion extend from each of the left and right frame edges 75*s* of the backrest frame 75. The upper connecting arm 77 is connected to an upper region of the standing portion 72*a* of the main frames 72 corresponding to left and right sides of the backrest support body 7, and the lower connecting arm 78 is connected to a lower region of the standing portion 72*a* of the main frames 72 corresponding to left and right sides of the backrest support body 7.

Figure 3:
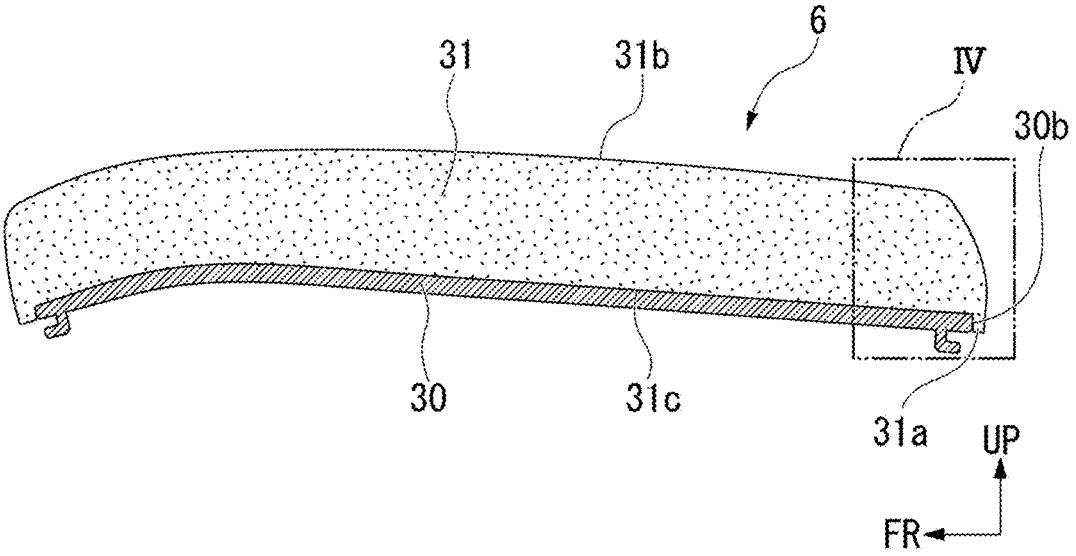
FIG. 3 is a view showing a cross section perpendicular to a leftward/rightward direction at a center position in a leftward/rightward direction of a seat according to the first embodiment.
Figure 4:
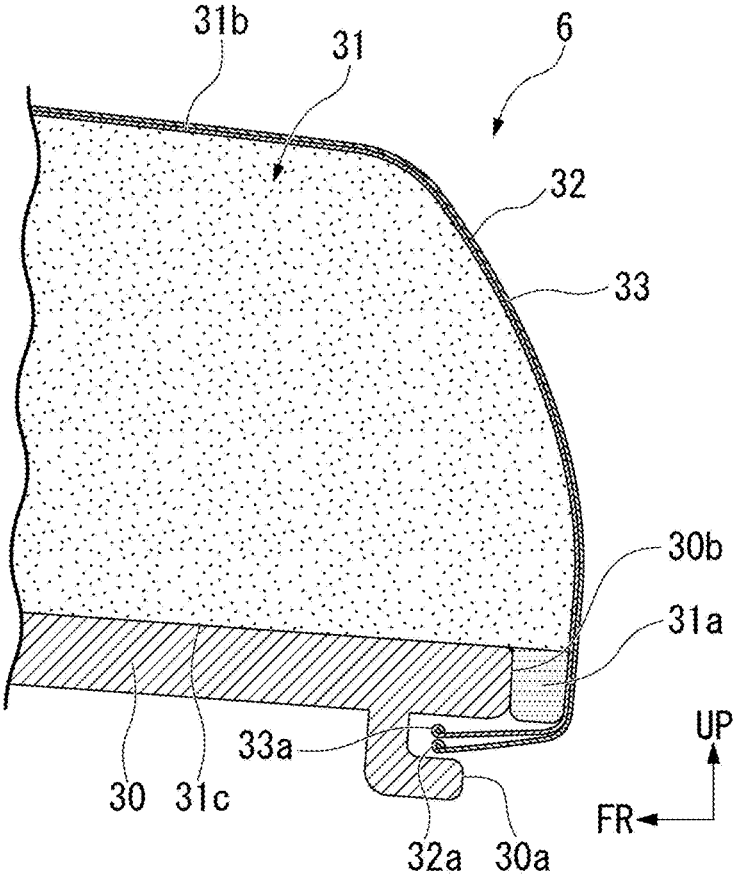
FIG. 4 is an enlarged cross-sectional view of the seat according to the first embodiment, showing a portion IV of FIG. 3.

The seat 6 will be described in detail with reference to mainly to FIG. 3 and FIG. 4. FIG. 3 is a view showing a cross section perpendicular to the leftward/rightward direction at a center position in the leftward/rightward direction of the seat 6 according to the first embodiment. FIG. 4 is an enlarged cross-sectional view of the seat 6 according to the first embodiment, showing a portion IV of FIG. 3. Further, in FIG. 3, illustration of an inner filling 33 and an outer covering 32 is omitted.

The seat plate 30 has a locking claw 30*a* provided on an outer circumferential portion. The locking claw 30*a* is provided on a bottom surface of the seat plate 30. The locking claw 30*a* protrudes toward an outer edge 30*b* of the seat plate 30. For example, the plurality of locking claws 30*a* are provided at intervals along the outer edge 30*b* of the seat plate 30.

The seat 6 further includes a cushion 31 disposed above the seat plate 30, the outer covering 32 configured to cover the cushion 31, and the inner filling 33 interposed between the cushion 31 and the outer covering 32, in addition to the above-mentioned seat plate 30.

Figure 5:
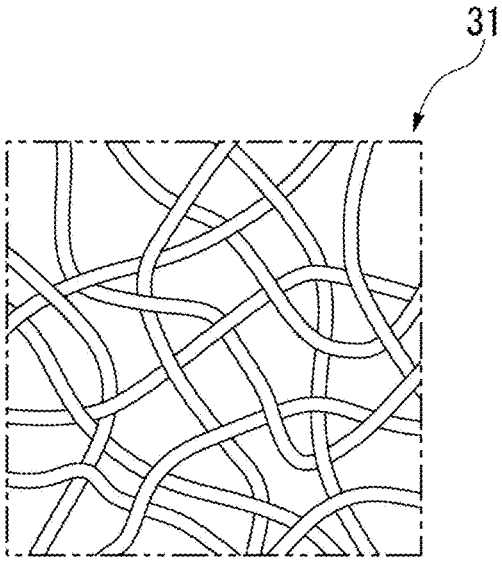
FIG. 5 is a view showing the structure of a net-like structure.

The cushion 31 is disposed along an upper surface of the seat plate 30 and supported by the seat plate 30. The cushion 31 has an upper surface 31*b*, which is a sitting surface, having a thickness in the upward/downward direction, and a lower surface 31*c* facing the upper surface of the seat plate 30. The cushion 31 is formed integrally as a whole. The cushion 31 is formed of a thermoplastic resin in a net-like structure (see FIG. 5). As for the thermoplastic resin, a single material with polyethylene as a raw material is applied. The net-like structure is formed of a single component having a desired shape obtained by intertwining a plurality of fibers (or filamentous resins). For example, the plurality of fibers are intertwined so as to be bonded to each other by melting. The cushion 31 has voids between the fibers of the net-like structure, and the fibers of the net-like structure undergo elastic deformation so that the voids shrink, thereby exhibiting cushioning properties. The cushion 31 has hardness distribution. For example, the hardness of the cushion 31 changes depending on a density of the fibers of the net-like structure. However, the hardness of the cushion 31 may change depending on a size of the fibers of the net-like structure.

The cushion 31 is disposed so as to overlap the entire seat plate 30 when seen from above. The cushion 31 has a convex portion 31*a* protruding downward. The convex portion 31*a* is provided on an outer circumferential portion of the bottom portion of the cushion 31. The cushion 31 is provided at a position where it protrudes outward beyond the seat plate 30 when seen in a plan view. The convex portion 31*a* is provided around the entire circumference of the cushion 31. However, the convex portion 31*a* may be provided on only a part of the outer circumferential portion of the cushion 31. The convex portion 31*a* is disposed along the outer edge 30*b* of the seat plate 30. The convex portion 31*a* is engaged with the outer edge 30*b* of the seat plate 30 such that the cushion 31 is restricted in displacement along the upper surface relative to the seat plate 30.

The inner filling 33 is provided to cover the cushion 31. The inner filling 33 directly covers the cushion 31. The inner filling 33 is not joined to the cushion 31, but may be joined to the cushion 31 by a removable joining means such as a suture, tacking, or the like. The inner filling 33 is formed of nonwoven fabric. The inner filling 33 covers the cushion 31 and prevents any irregularities on the outer surface of the cushion 31 from appearing on the outer surface of the seat 6. Further, the irregularities on the outer surface of the cushion 31 are formed by fibers, voids, and the like, of the net-like structure. The nonwoven fabric that forms the inner filling 33 has smaller gaps between the fibers than the net-like structure that forms the cushion 31. However, the gap between the fibers of the nonwoven fabric does not have to be uniform throughout the inner filling 33, and it is sufficient that a mode or an average value of the gap size is lower than that of the net-like structure.

The inner filling 33 covers the entire cushion 31 that is not covered by the seat plate 30. Before covering the cushion 31, the inner filling 33 is formed in a sheet shape that is larger than the cushion 31 when seen in a plan view. The inner filling 33 passes from above the cushion 31 along the side of the cushion 31, straddles a lower side of the convex portion 31*a* of the cushion 31, and wraps around to the bottom of the seat plate 30. The outer circumferential edge portion of the inner filling 33 is located below the outer circumferential portion of the seat plate 30. A bag-shaped cord insertion part 33*a* is provided around approximately the entire periphery of the outer circumferential edge portion of the inner filling 33. A cord with ends is inserted into the cord insertion part 33*a*. The cord tightens the outer circumferential edge portion of the inner filling 33 so that the outer circumferential edge portion of the inner filling 33 becomes smaller than the outline of the seat plate 30 when seen in a plan view. Both end portions of the cord are pulled outward through exits formed in the cord insertion part 33*a* and fixed to each other. The cord insertion part 33*a* is locked to the locking claw 30*a* of the seat plate 30.

The outer covering 32 integrally forms upper and side surfaces of the outer surfaces of the seat 6. The side surfaces are surfaces facing a direction perpendicular to the upward/downward direction, and the outer covering 32 covers the entire outer surface of the inner filling 33, and thereby covers the portion of the cushion 31 that is covered by the inner filling 33. The outer covering 32 is formed of a fabric material, a vinyl leather material, a natural leather material, or the like.

The outer covering 32 has a shape similar to that of the inner filling 33, and the outer covering 32 passes from above the cushion 31 along the side of the cushion 31, straddles the convex portion 31*a* of the cushion 31 below, and wraps around to the bottom of the seat plate 30. A bag-shaped cord insertion part 32*a*, through which the cord is inserted, is provided around substantially the entire circumference of the outer circumferential edge portion of the outer covering 32. The cord tightens the outer circumferential edge portion of the outer covering 32 such that the outer circumferential edge portion of the outer covering 32 becomes smaller than the outline of the seat plate 30, preferably the outer circumferential edge portion of the inner filling 33 when seen in a plan view. Both end portions of the cord are pulled outward through exits formed in the cord insertion part 32*a* and fixed to each other. The cord insertion part 33*a* is locked to the locking claw 30*a* of the seat plate 30. Further, since the outer circumferential edge portion of the outer covering 32 and the outer circumferential edge portion of the inner filling 33 abut in a state having a tension at the outer edge 30*b* of the seat plate 30 while having the convex portion 31*a* of the cushion 31 therebetween, even if the outer edge 30*b* of the seat plate 30 has an angular shape, it is unlikely to be damaged.

Figure 6:
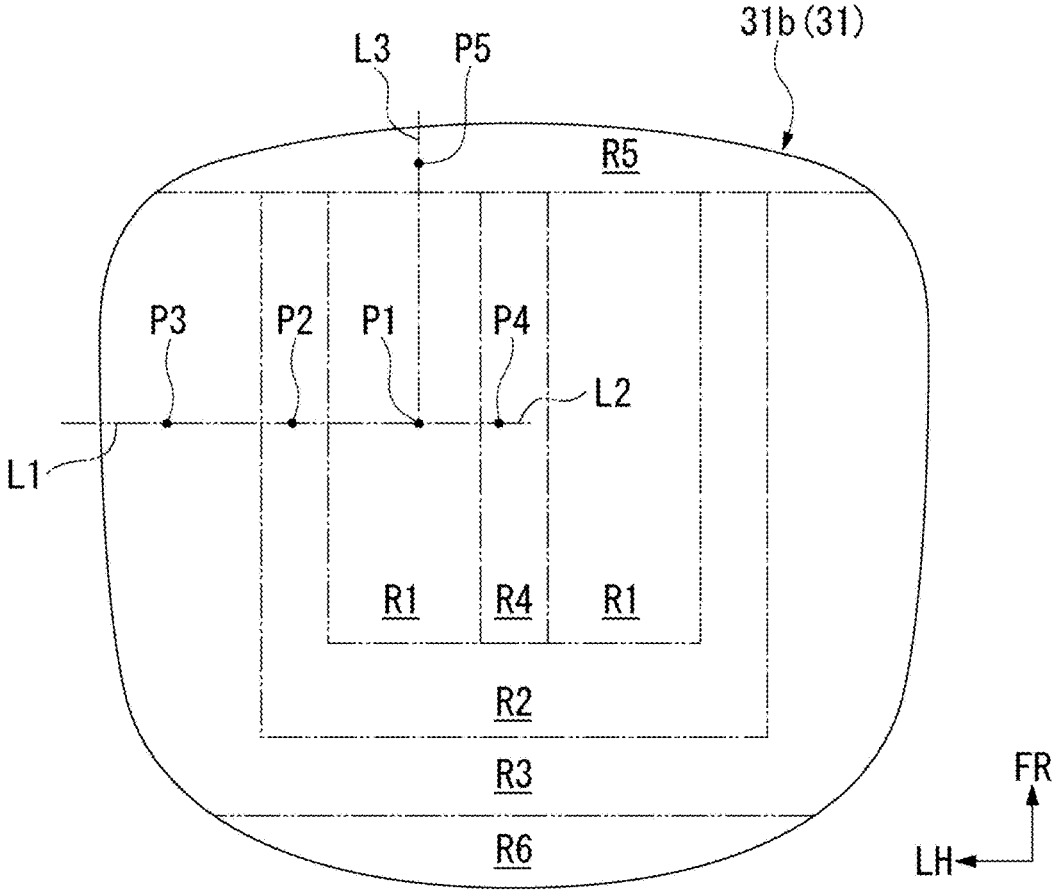
FIG. 6 is a view showing distribution of hardness in an upper surface of a cushion according to the first embodiment.

Here, hardness of the cushion 31 will be described with reference to FIG. 6. FIG. 6 is a view showing distribution of hardness in the upper surface 31*b* of the cushion 31 according to the first embodiment. Further, in the following description, the hardness of the cushion 31 is a numerical value obtained by performing measurement using rubber hardness meter made by Kobunshi Keiki Co., Ltd. (Model No.: Aska Rubber Hardness Meter F Type).

Distribution of hardness of the upper surface 31*b* and the lower surface 31*c* of the cushion 31 will be described. Further, in the embodiment, the hardness distribution of the upper surface 31*b* of the cushion 31 is laterally symmetrical and coincides with the hardness distribution of the lower surface 31*c* of the cushion 31 in the height direction. In other words, a region having the same hardness in the lower surface 31*c* of the cushion 31 is disposed below a region set to certain hardness in the upper surface 31*b* of the cushion 31. Further, in the following description, only hardness distribution on the upper surface 31*b* of the cushion 31 will be described. Each region of the upper surface 31*b* of the cushion 31 is defined as follows according to the hardness distribution of the upper surface 31*b*. Further, in the embodiment, regions, which will be described below, are separated from each other by boundaries linearly extending in the forward/rearward direction or the leftward/rightward direction when seen in a plan view. The upper surface 31*b* of the cushion 31 includes a pair of first regions R1, a second region R2, and a third region R3.

Each of the first regions R1 is a region that supports a sitting person's buttocks. All places in the first regions R1 support some areas in a range from the sitting person's buttocks to rear portions of the femoral regions. A place that supports the sitting person's ischium is included in the first regions R1. That is, the first regions R1 are regions that extend forward, rearward, leftward and rightward from the most loaded point where the sitting load in the distribution of the sitting load acting on the cushion 31 is maximized. The first regions R1 are disposed at an inner side of the outer edge of the upper surface 31*b* of the cushion 31. Each of the first regions R1 has a rectangular shape when seen in a plan view. The pair of first regions R1 has an interval on a center in the leftward/rightward direction in the upper surface 31*b* of the cushion 31. Each of the first regions R1 includes a center in the forward/rearward direction of the upper surface 31*b* of the cushion 31. Regarding the size of each region R1 in the forward/rearward direction, a portion in front of the center in the forward/rearward direction of the upper surface 31*b* of the cushion 31 is greater than a portion behind the center.

The second region R2 is adjacent to an outer side of the pair of first regions R1 when seen in a plan view. The outer side is a direction from a reference position toward an outer edge of the upper surface 31*b* of the cushion 31 when seen in a plan view. That is, the second region R2 is a direction from the first regions R1 toward an outer edge of the upper surface 31*b* of the cushion 31 when seen in a plan view. The second region R2 is located on an inner side of the outer edge of the upper surface 31*b* of the cushion 31. The second region R2 encloses the pair of first regions R1 together. In the example shown, the second region R2 has a U shape, a forward side of which is open, when seen in a plan view, and surrounds the pair of first regions R1 from the rear and both left and right sides. In the second region R2, a size in the leftward/rightward direction of both left and right side portions extending in the forward/rearward direction is smaller than a size in the forward/rearward direction of the rear portion extending in the leftward/rightward direction.

The third region R3 includes a region to which the sitting load is not directly applied. The third region R3 is adjacent to an outer side of the second region R2 when seen in a plan view. That is, the third region R3 is a direction from the second region R2 toward an outer edge of the upper surface 31*b* of the cushion 31 when seen in a plan view. The third region R3 is located on a side opposite to the pair of first regions R1 with the second region R2 sandwiched therebetween, and surrounds the second region R2. In the example shown, the third region R3 has a U shape, a forward side of which is open, when seen in a plan view, and surrounds the second region R2 from the rear and both left and right sides. The third region R3 includes an outer circumferential portion of the upper surface 31*b* of the cushion 31. That is, the third region R3 includes at least a part of the outer edge of the upper surface 31*b* of the cushion 31. In the example shown, the third region R3 includes both left and right edges of the upper surface 31*b* of the cushion 31, and is spaced apart by an interval in the forward/rearward direction from the front edge and the rear edge of the upper surface 31*b* of the cushion 31. In the third region R3, a size in the leftward/rightward direction of both left and right side portions extending in the forward/rearward direction is greater than a size in the forward/rearward direction of the rear portion extending in the leftward/rightward direction.

Definition of the pair of first regions R1, the second region R2, and the third region R3 can be rephrased as follows. The third region R3 is an outer circumferential region including the outer circumferential portion of the upper surface 31*b* of the cushion 31. The pair of first regions R1 are central regions located on an inner side of the third region R3. The inner side is a direction from a reference position to a center of the upper surface 31*b* of the cushion 31 when seen in a plan view. The pair of first regions R1 are located at both left and right sides with the center in the leftward/rightward direction of the upper surface 31*b* of the cushion 31 interposed therebetween. The second region R2 is an intermediate region located between the third region R3 and the first regions R1. The second region R2 is adjacent to an inner side of the third region R3 and is adjacent to an outer side of the first regions R1.

At positions in the forward/rearward direction where the first regions R1, the second region R2 and the third region R3 are arranged in the leftward/rightward direction, a size in the leftward/rightward direction of the first regions R1 and the third region R3 is greater than a size in the leftward/rightward direction of the second region R2. At positions in the leftward/rightward direction where the first regions R1, the second region R2 and the third region R3 are arranged in the forward/rearward direction, a size in the forward/rearward direction of the second region R2 is smaller than a size in the forward/rearward direction of the first regions R1 and is greater than a size in the forward/rearward direction of the third region R3.

Hardness of the first regions R1, the second region R2 and the third region R3 is set as follows. Here, a first imaginary half line L1, a first place P1, a second place P2 and a third place P3 are defined. The first place P1 is an arbitrary point in the first regions R1. The first imaginary half line L1 extends outward from the first place P1 when seen in a plan view, and continuously passes through the first regions R1, the second region R2 and the third region R3. In FIG. 6, as the example of the first imaginary half line L1, the first imaginary half line L1 extending outward from the first place P1 in the leftward/rightward direction is shown. For example, the first imaginary half line may extend rearward from the first place P1. The second place P2 is an arbitrary point on the first imaginary half line L1 in the second region R2. The third place P3 is an arbitrary point on the first imaginary half line L1 of the third region R3. That is, the second place P2 is located on an outer side of the first place P1, and the third place P3 is located on an outer side of the second place P2. The first place P1 has a first hardness. The second place P2 has a second hardness. The second hardness is higher than the first hardness. The third place P3 has a third hardness. The third hardness is higher than the second hardness.

The first regions R1 have uniform hardness as a whole. The second region R2 may have uniform hardness as a whole, or may have a distribution of hardness. For example, both left and right side portions extending in the forward/rearward direction of the second region R2 may be formed such that hardness is increased reward from the front end. For example, the rear portion of the second region R2 extending in the leftward/rightward direction may be formed such that hardness is increased from the center in the leftward/rightward direction toward an outer side in the leftward/rightward direction. In these cases, the second region R2 may include a plurality of small region with different hardness, or may be formed such that the hardness changes continuously. In the embodiment, the hardness of all places in the second region R2 is higher than the hardness of the first regions R1. The third region R3 is also the same as the second region R2.

Since the first place P1, the second place P2 and the third place P3 are disposed as described above, the cushion 31 have the following configuration. The cushion 31 has a first hardness at a position where the sitting person's buttocks come into contact, a second hardness on the outer side of the first hardness, and a third hardness on the outer side of the second hardness.

The upper surface 31*b* of the cushion 31 further includes a fourth region R4 (a central region), a fifth region R5, and a sixth region R6.

The fourth region R4 includes a central portion of the upper surface 31*b* of the cushion 31 in the leftward/rightward direction. The fourth region R4 is a region between the pair of first regions R1. The fourth region R4 includes a center of the upper surface 31*b* of the cushion 31 in the leftward/rightward direction. Hardness of the fourth region R4 is set as follows. Here, a fourth place P4 is defined relative to the first place P1 described above. The fourth place P4 is an arbitrary point in the fourth region R4 on a second imaginary half line L2 extending inward from the first place P1 in the leftward/rightward direction when seen in a plan view and continuously passing through the first regions R1 and the fourth region R4. The fourth place P4 has a fourth hardness. The fourth hardness may be higher than the first hardness, but preferably, may be equal to or greater than the second hardness and equal to or lower than the third hardness. In the embodiment, the fourth region R4 has uniform hardness. Since the fourth region R4 is disposed relative to the first regions R1 as described above, the cushion 31 has a higher hardness in the central portion in the leftward/rightward direction than the first hardness.

The fifth region R5 supports a front portion of the sitting person's femoral regions. The fifth region R5 is located in front of the pair of first regions R1 when seen in a plan view. The fifth region R5 includes a front edge of the upper surface 31*b* of the cushion 31. The fifth region R5 extends in the leftward/rightward direction. The fifth region R5 is adjacent to front sides of the first regions R1, the second region R2, the third region R3 and the fourth region R4. The hardness of the fifth region R5 is set as follows. Here, a fifth place P5 (a forward place) is defined in relation to the first place P1 described above. The fifth place P5 is an arbitrary point of the fifth region R5 on a third imaginary half line L3 extending forward from the first place P1 when seen in a plan view and continuously passing through the first regions R1 and the fifth region R5. The fifth place P5 has a fifth hardness. The fifth hardness is equal to or lower than the first hardness. In the embodiment, the fifth hardness may be lower than the second hardness, but preferably, may be lower than the first hardness. Further, the fifth region R5 is a place adjacent to the second region R2 and has hardness lower than the hardness of the place in the second region R2 adjacent to the fifth region R5. The same applies to the places in the fifth region R5 adjacent to the third region R3 and the fourth region R4. In the embodiment, the hardness of the entire fifth region R5 is equal to or lower than the first hardness. The hardness of the place in the fifth region R5 located in front of the first regions R1 is lower than hardness of other places. Since the fifth region R5 is disposed relative to the first regions R1 as described above, the cushion 31 has hardness equal to or lower than the first hardness in front of the position where the sitting person's buttocks abuts.

The sixth region R6 is located behind the pair of first regions R1 when seen in a plan view. The sixth region R6 includes a rear edge of the upper surface 31*b* of the cushion 31. The sixth region R6 extends in the leftward/rightward direction. The sixth region R6 is adjacent to a rear side of the third region R3. An arbitrary place of the sixth region R6 has hardness lower than that of a place adjacent the arbitrary place in the third region R3. In the embodiment, the hardness of the entire sixth region R6 is equal to or lower than the first hardness.

Further, the convex portion 31*a* of the cushion 31 has hardness higher than the first hardness due to heat treatment or the like after molding. In the embodiment, the entire convex portion 31*a* has hardness higher than the hardness of the entire place of the first regions R1, and has the same hardness as the third hardness. Further, the convex portion 31*a* may have hardness equal to or greater than the third hardness. Further, the convex portion 31*a* formed in the fifth region R5 having the hardness that is equal to or lower than the first hardness also has the same hardness as the third hardness.

Figure 7:
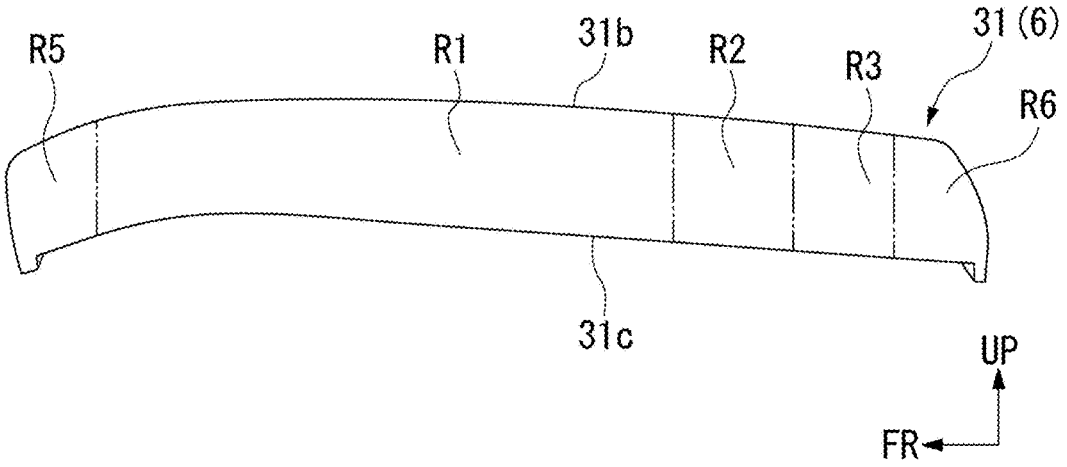
FIG. 7 is a view showing distribution of each structure of the net-like structure in a cross section of the cushion shown in FIG. 3.

FIG. 7 is a view showing a distribution for each structure of the net-like structure in the cross section of the cushion 31 shown in FIG. 3.

As shown in FIG. 7, the cushion 31 has a structure penetrating it in the upward/downward direction to exhibit the cushioning properties. The structure required to exhibit the cushioning properties is a density of the fibers of the net-like structure, a thickness of the fiber, or the like. Accordingly, the cushion 31 is formed such that the hardness distribution in the upper surface 31*b* and the hardness distribution in the lower surface 31*c* coincide with each other when seen in the upward/downward direction. Accordingly, at least the first hardness, the second hardness and the third hardness are provided at the same vertical position of the cushion 31. However, the convex portion 31*a* provided on the bottom portion of the cushion 31 may be formed to have hardness different from the neighboring place.

As described above, the upper surface 31*b* of the cushion 31 of the chair 1 of the embodiment has the first place P1 that has a first hardness and that is configured to support the sitting person's buttocks, the second place P2 that is located outside of the first place P1 when seen in a plan view and that has a second hardness higher than the first hardness, and the third place P3 that is located outside of the second place P2 when seen in a plan view and that has a third hardness higher than the second hardness. According to the configuration, the sitting person's buttocks sink deeper into the seat 6 as they move inward when seen in a plan view, and becomes a state such as enveloped. In the embodiment, the sitting person's buttocks becomes enveloped from the outside in the leftward/rightward direction and the rear side. In this state, as a part of the sitting person's buttocks in which sinking in to the cushion 31 is shallower, it is supported by a place having higher hardness in the cushion 31. Accordingly, when sitting, the buttocks are less likely to slip outward, allowing the person to sit in a stable position. Accordingly, the chair 1 provides good seating comfort.

Further, since the cushion 31 is formed with the net-like structure made of the thermoplastic resin, it is different from the case in which the cushion 31 is formed of urethane foam, and a waste matter of the cushion 31 can be reused as a closed loop recycled material.

As described above, the chair 1 is closed loop recyclable and capable of providing good seating comfort.

In addition, the cushion 31 is formed with the net-like structure, which makes it easy to ensure air permeability, and the fact that it is made of the resin also makes it easy to clean.

The cushion 31 further has the fifth place P5 that is located in front of the first place P1 and that has hardness equal to or lower than the first hardness. According to this configuration, since the fifth place P5, with which the sitting person's femoral regions come into contact, is set to hardness equal to or lower than the first hardness, a portion of the cushion 31 with low hardness comes into contact with the sitting person's femoral regions. Accordingly, the feeling of pressure on the femoral regions is reduced. Accordingly, the seating comfort can be further improved.

A distribution of the hardness in the upper surface 31*b* of the cushion 31 coincides with the distribution of the hardness in the lower surface 31*c* of the cushion 31 when seen in the upward/downward direction. According to this configuration, the structure of exhibiting the hardness of the cushion 31 is provided to pass through the cushion 31 in the upward/downward direction. If the distribution of the hardness changes depending on the a depth position with reference to the upper surface 31*b* of the cushion 31, the seating comfort can change depending on the size of the area with which the sitting person's buttocks come into contact when the buttocks sink in. Accordingly, according to the embodiment, a consistent seating comfort is provided regardless of the sitting person's body type, weight, or the like.

The cushion 31 has the pair of first regions R1 including the first place P1 and having an interval on a center of the upper surface 31*b* in the leftward/rightward direction, and the fourth region R4 located between the pair of first regions and including a central portion of the upper surface in the leftward/rightward direction. The hardness of the fourth region R4 is higher than the first hardness. According to this configuration, the first region R1, which has the first hardness, can provide seating comfort for the buttocks to sink in, and the fourth region R4, which has a fourth hardness higher than the first hardness, can hold the buttocks even less likely to slip. Accordingly, the seating comfort can be further improved. In addition, compared to the configuration in which the central portion of the cushion 31 in the leftward/rightward direction has the first hardness, sagging of the cushion 31 can be suppressed.

The cushion 31 has the convex portion 31*a* that is disposed along the outer edge 30*b* of the seat plate 30 and that is engaged with the outer edge 30*b*. According to this configuration, the convex portion 31*a* engages with the outer edge 30*b* of the seat plate 30, making it difficult for the cushion 31 to slip relative to the seat plate 30. In particular, in the embodiment, since the hardness of the convex portion 31*a* is higher than the first hardness, the above-mentioned effects can be more effectively obtained. Accordingly, the cushion 31 can be stably supported by the seat plate 30.

Further, the worker can hook his/her fingers onto the convex portion 31*a*, making it easier for the worker to grasp the cushion 31.

The seat 6 includes the inner filling 33 interposed between the cushion 31 and the outer covering 32. According to this configuration, this can prevent irregularities on the outer surface of the cushion 31 from exhibiting in the outer covering 32. Accordingly, the irregularities on the outer surface of the cushion 31 are less likely to appear on the outer surface of the seat 6, and deterioration of the seating comfort can be suppressed by making the cushion 31 have a net-like structure.

Figure 8:
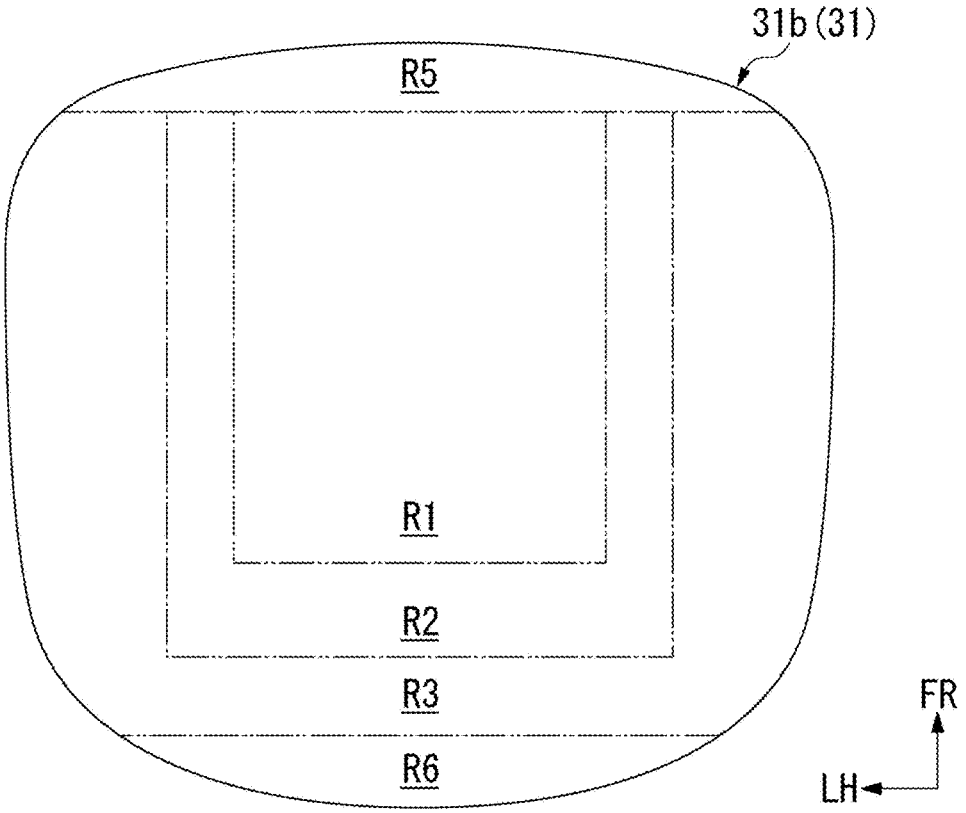
FIG. 8 is a view showing distribution of hardness in an upper surface of a cushion according to a first variant of the first embodiment.

Further, in the first embodiment, while the fourth region R4 is provided on the upper surface 31*b* of the cushion 31, it is not limited to the configuration. As shown in FIG. 8, the pair of first regions R1 of the upper surface 31*b* of the cushion 31 may be adjacent to and integrated with each other, and the fourth region R1 may not be provided.

Figure 9:
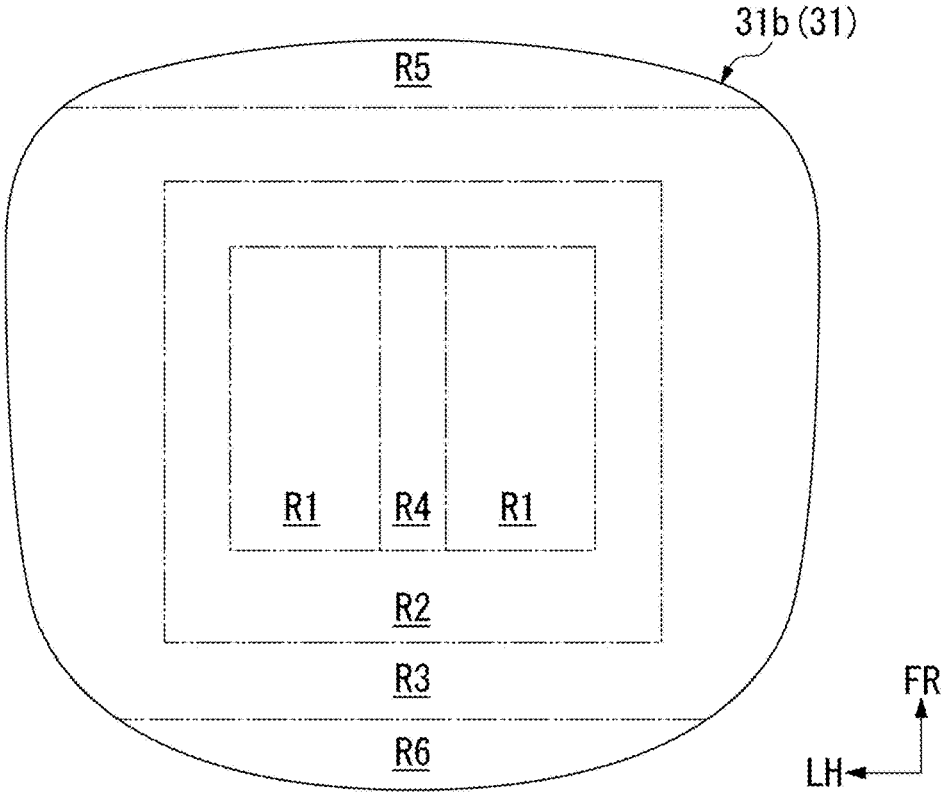
FIG. 9 is a view showing distribution of hardness in an upper surface of a cushion according to a second variant of the first embodiment.
Figure 10:
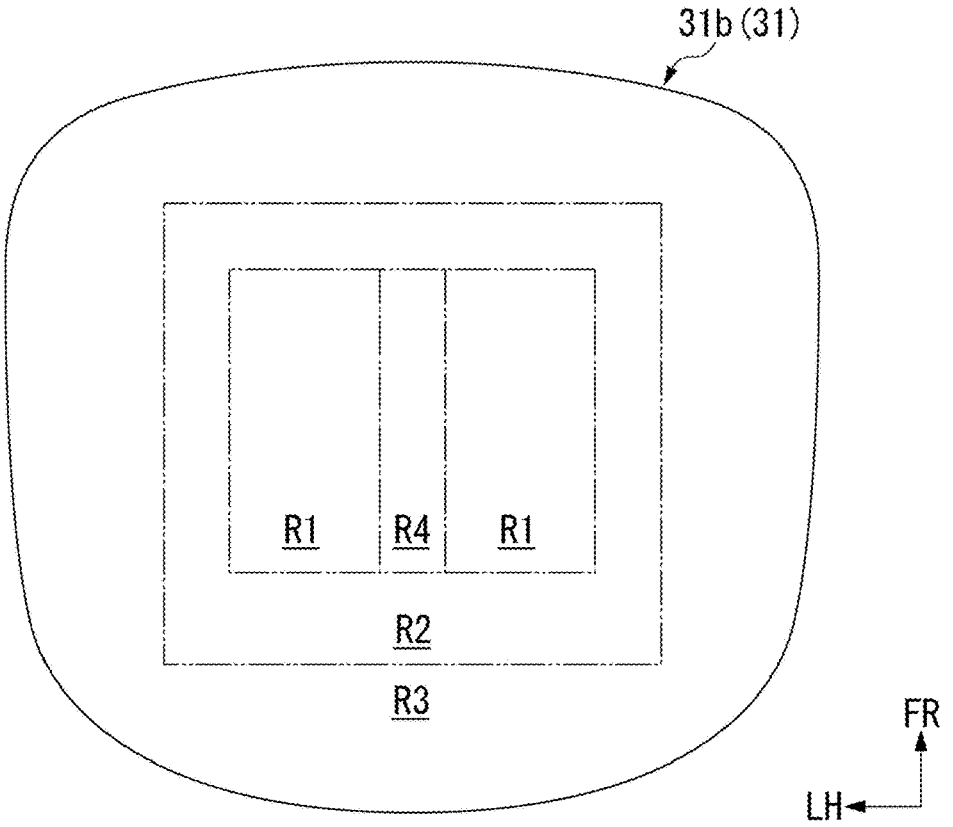
FIG. 10 is a view showing distribution of hardness in an upper surface of a cushion according to a third variant of the first embodiment.

In addition, in the first embodiment, while the second region R2 and the third region R3 of the upper surface 31*b* of the cushion 31 surround the first regions R1 from three directions except the forward direction when seen in a plan view, it is not limited to the configuration and may be configured as shown in FIG. 9 or FIG. 10. As shown in FIG. 9, the second region R2 encloses the pair of first regions R1. The second region R2 has a rectangular frame shape when seen in a plan view. That is, the second region R2 surrounds the pair of first regions R1 from both sides in the forward/rearward direction and both left and right sides. The third region R3 surrounds the second region R2. The third region R3 has a rectangular frame shape when seen in a plan view. That is, the third region R3 surrounds the second region R2 from both sides in the forward/rearward direction and both left and right sides. Even in this configuration, it is desirable to have the fifth region R5 located in front of the pair of first regions R1. However, as shown in FIG. 10, the fifth region R5 and the sixth region R6 do not need to be provided. In this case, the third region R3 includes the entire outer edge of the upper surface 31*b* of the cushion 31. Further, the second region R2 and the third region R3 do not necessarily have to be provided behind the first regions R1.

Second Embodiment

Figure 11:
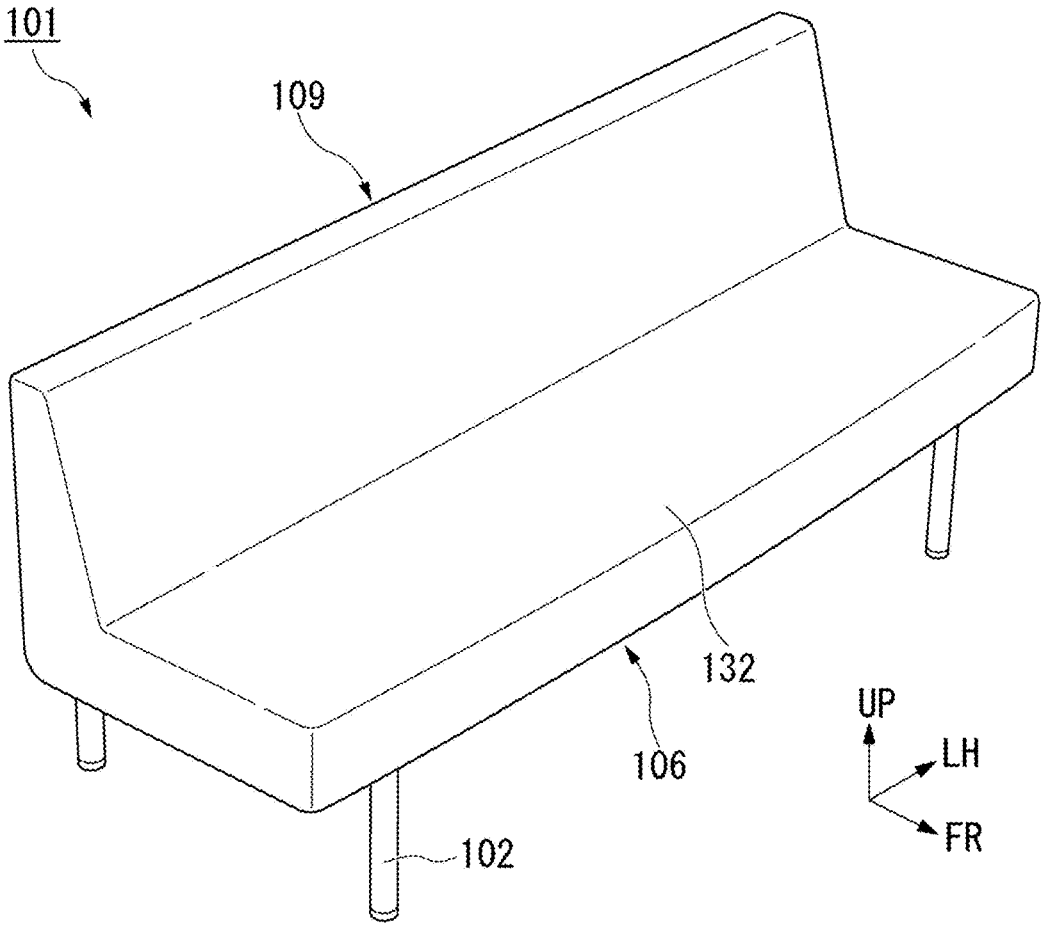
FIG. 11 is a perspective view showing a chair according to a second embodiment from a front side.

FIG. 11 is a perspective view of a chair 101 according to a second embodiment when seen from the front. Further, the configuration other than the following description is the same as that of the first embodiment.

As shown in FIG. 11, the chair 101 of the second embodiment is a bench on which a plurality of users can sit side by side in a lateral direction. The chair 101 includes legs 102, a seat 106 that supports a sitting person's buttocks, and a backrest 109 that supports the sitting person's back.

The legs 102 have grounding parts. The legs 102 extend upward from the grounding parts, and a sitting load is transferred from the seat 106 to the floor surface F. The pair of legs 102 are provided on the front and the rear of the chair 101 on both left and right side portions. The seat 106 is supported by the legs 102. The seat 106 is formed in a rectangular shape that is long in the leftward/rightward direction and short in the forward/rearward direction when seen in a plan view. The backrest 109 is formed to extend upward from the rear end portion of the seat 106.

The seat 106 includes an outer covering 132, a cushion 131 (see FIG. 12) covered with the outer covering 132, an inner filling (not shown) interposed between the cushion 131 and the outer covering 132, and a seat plate (not shown) that supports the cushion 131 from below. The cushion 131 is formed with a net-like structure made of a thermoplastic resin, like the cushion 31 of the first embodiment. The cushion 131 has a distribution of hardness.

Figure 12:
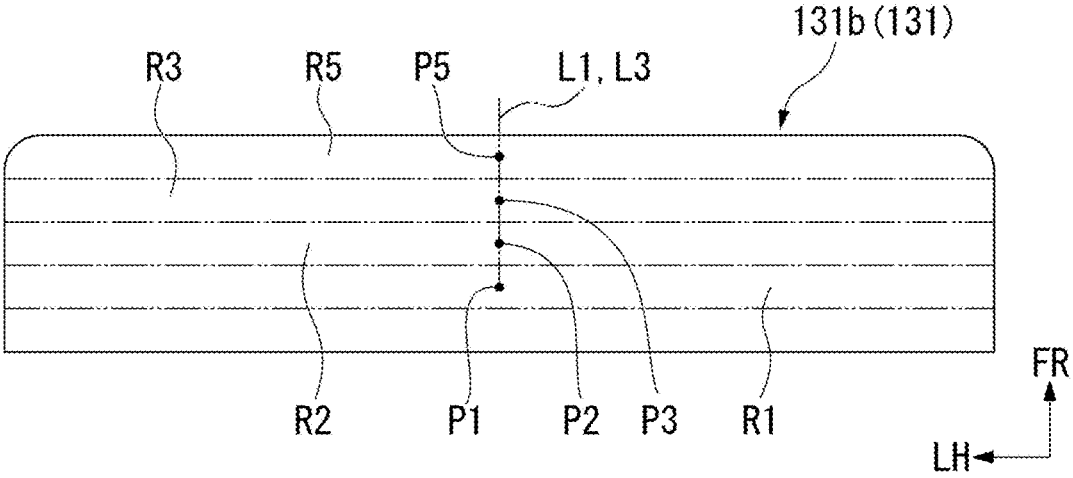
FIG. 12 is a view showing distribution of hardness in an upper surface of a cushion according to the second embodiment.

The hardness of the cushion 131 will be described with reference to FIG. 12. FIG. 12 is a view showing a distribution of hardness on an upper surface 131*b* of the cushion 131 according to the second embodiment. Further, in the embodiment, the distribution of the hardness of the upper surface 131*b* of the cushion 131 is laterally symmetrical. Each region of the upper surface 131*b* of the cushion 131 is defined as follows according to the distribution of the hardness of the upper surface 131*b*. Further, in the embodiment, regions, which are described below, are separated from each other by boundaries that extend linearly in the leftward/rightward direction when seen in a plan view. The upper surface 131*b* of the cushion 131 includes a first region R1, a second region R2, and a third region R3.

The first regions R1 are regions that support the sitting person's buttocks. All places in the first regions R1 support the sitting person's buttocks. The first regions R1 are located inside (behind) the front edge of the upper surface 131*b* of the cushion 131. The first regions R1 have a certain width in the forward/rearward direction and extend in the leftward/rightward direction over the entire length of the upper surface 131*b* of the cushion 131. The first regions R1 include a center of the upper surface 131*b* of the cushion 131 in the forward/rearward direction.

The second region R2 is adjacent to outer sides of the first regions R1 when seen in a plan view. The second region R2 is located inside (behind) the front edge of the upper surface 131*b* of the cushion 131. The second region R2 is adjacent to the entire first regions R1 in the front. The second region R2 has a constant width in the forward/rearward direction, and extends in the leftward/rightward direction over the entire length of the upper surface 131*b* of the cushion 131.

The third region R3 is adjacent to an outer side of the second region R2 when seen in a plan view. The third region R3 located at a side opposite to the pair of first regions R1 with the second region R2 sandwiched therebetween. The third region R3 is located inside (behind) the front edge of the upper surface 131*b* of the cushion 131. The third region R3 is adjacent to the entire second region R2 in the front. The third region R3 has a constant width in the forward/rearward direction, and extends in the leftward/rightward direction over the entire length of the upper surface 131*b* of the cushion 131.

The hardness of the first regions R1, the second region R2 and the third region R3 are set as follows. Here, the first imaginary half line L1, the first place P1, the second place P2 and the third place P3 are defined. The first place P1 is an arbitrary point in the first regions R1. The first imaginary half line L1 extends outward from the first place P1 when seen in a plan view, and continuously passes through the first regions R1, the second region R2 and the third region R3. In the embodiment, the first imaginary half line L1 extends in a direction inclined forward from the first place P1 of the first regions R1 in the leftward/rightward direction due to the above-mentioned positional relation between the first regions R1, the second region R2 and the third region R3. In FIG. 12, as an example of the first imaginary half line L1, the first imaginary half line L1 extending forward from the first place P1 is shown. The second place P2 is an arbitrary point in the second region R2 on the first imaginary half line L1. The third place P3 is an arbitrary point in the third region R3 on the first imaginary half line L1. That is, the second place P2 is located in front of the first place P1, and the third place P3 is located in front of the second place P2. The first place P1 has a first hardness. The second place P2 has a second hardness. The second hardness is higher than the first hardness. The third place P3 has a third hardness. The third hardness is higher than the second hardness.

The first regions R1 may have entirely uniform hardness, or may not have a distribution of hardness. For example, the first regions R1 may have a distribution of hardness with periodicity in the leftward/rightward direction according to a maximum number of people who can sit on the chair 101. The second region R2 and the third region R3 are also the same as the first regions R1. In the embodiment, the hardness of all places in the second region R2 is higher than the hardness of the first regions R1. The third region R3 is also the same as the second region R2.

Since the first place P1, the second place P2 and the third place P3 are disposed as described above, the cushion 131 has the following configuration. The cushion 131 has a first hardness at a position with which the sitting person's buttocks come into contact, a second hardness outside the first hardness, and a third hardness outside the second hardness.

The upper surface 131*b* of the cushion 131 further includes the fifth region R5.

The fifth region R5 supports front portions of the sitting person's femoral regions. The fifth region R5 is located in front of the first regions R1 when seen in a plan view. The fifth region R5 includes a front edge of the upper surface 131*b* of the cushion 131. That is, the fifth region R5 is adjacent to the third region R3 in the front. The fifth region R5 extends in the leftward/rightward direction. The hardness of the fifth region R5 is set as follows. Here, the fifth place P5 is defined in relation to the first place P1 described above. The fifth place P5 is an arbitrary point in the fifth region R5 on the third imaginary half line L3 extending forward from the first place P1 when seen in a plan view and continuously passing through the first regions R1 and the fifth region R5. The fifth place P5 has a fifth hardness. The fifth hardness is equal to or lower than the first hardness. In the embodiment, the hardness of the entire fifth region R5 is equal to or lower than the first hardness. Since the fifth region R5 is disposed relative to the first regions R1 as described above, the cushion 131 has hardness equal to or lower than the first hardness in front of the position with which the sitting person's buttocks come into contact.

As described above, since the seat 106 of the chair 101 of the embodiment has the cushion 131 formed with the net-like structure made of a thermoplastic resin, the same effect as the first embodiment can be obtained. In addition, in the embodiment, the sitting person's buttocks becomes a state in which they are enveloped from the front. Accordingly, when sitting, the buttocks are less likely to slip outward, allowing the person to sit in a stable position. Accordingly, the chair 101 with good seating comfort is obtained.

Further, the cushion 131 further has the fifth place P5 that is located in front of the first place P1 and that has hardness equal to or lower than the first hardness. According to this configuration, since the fifth place P5 with which the sitting person's femoral regions come into contact is set to hardness equal to or lower than the first hardness, a portion of the cushion 131 with low hardness comes into contact with the sitting person's femoral regions. Accordingly, the feeling of pressure on the femoral regions is reduced. Accordingly, the seating comfort can be further improved.

Further, in the example shown, all the first regions R1 are spaced apart from the rear edge of the upper surface 131*b* of the cushion 131 in the forward/rearward direction. In this case, a region between the first regions R1 and the rear edge of the upper surface 131*b* of the cushion 131 preferably has the second hardness. Accordingly, since the change in hardness from the first regions R1 to the rear end of the cushion 131 is suppressed, it is easier for the first regions R1 to sink downward.

Figure 13:
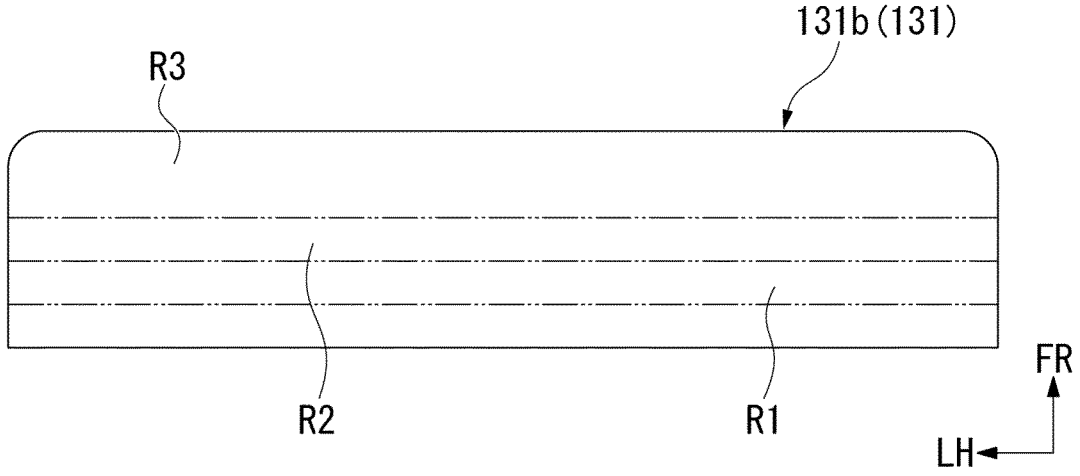
FIG. 13 is a view showing distribution of hardness in an upper surface of a cushion according to a variant of the second embodiment.

Further, in the above-mentioned second embodiment, while the fifth region R5 is provided on the upper surface 131*b* of the cushion 131, it is not limited to the configuration. As shown in FIG. 13, the third region R3 may be formed to include the front edge of the upper surface 131*b* of the cushion 131.

Further, the present invention is not limited to the above-mentioned embodiment described with reference to the drawings, and various variants are conceivable without departing from the technical scope.

For example, in the above-mentioned embodiment, although the chair has a backrest, the present invention is not limited to this and can also be applied to a seat of a chair that does not have a backrest.

In the above-mentioned embodiment, while the net-like structure that forms the cushion uses polyethylene as its raw material, the raw material of the net-like structure is not limited thereto, and any known thermoplastic resin can be used alone or in combination with multiple types. The thermoplastic resin that can be used as the raw material for the net-like structure includes, for example, polypropylene, polyvinyl chloride, polystyrene, polyester, or the like, in addition to polyethylene. By forming the net-like structure using the thermoplastic resin, the cushion after use can be closed loop recycled and reused as the raw material for the net-like structure.

In the embodiment, although the legs and the seat are separate components, it is not limited to the configuration. That is, the legs and the seat may be formed integrally. In addition, the legs and the seat may be covered with the outer covering integrally.

In the embodiment, while the inner filling is interposed between the seat and the outer covering, it is not limited to the configuration. That is, the outer covering may directly cover the seat.

In the embodiment, each regions on the upper surface of the cushion is separated by linear boundaries that correspond to the distribution of hardness. Further, when the cushion is urethane foam, since multiple types of urethane concentrates, each designed to have a different hardness after curing, are injected into the mold in a liquid form, the boundaries between the region after curing become curved, whereas in the cushion of the above-mentioned embodiment, the boundaries of each regions on the upper surface of the cushion are straight. Each regions of the cushion upper surface can be bounded by a boundary extending in a polygonal line formed by multiple angles and different straight lines. However, at least a part of the boundary separating each regions may extend in a curved shape.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A chair comprising a backrest, a seat and legs, wherein the seat includes:

a cushion formed with a structure made of a thermoplastic resin;

a seat plate configured to support the cushion; and an outer covering configured to cover the cushion, and wherein an upper surface of the cushion includes:

a first place that has a first hardness and that is configured to support a sitting person's buttock;

a second place that is located outside of the first place when seen in a plan view and that has a second hardness higher than the first hardness; and a third place that is located outside of the second place when seen in a plan view and that has a third hardness higher than the second hardness, wherein a distribution of hardness in the upper surface of the cushion coincides with a distribution of hardness in a lower surface of the cushion when seen in a height direction.

2. The chair according to claim 1, wherein the cushion further includes a forward place that is located in front of the first place and that has hardness equal to or lower than the first hardness.

3. The chair according to claim 1, wherein the cushion includes:

a pair of first regions that include the first place positioned having an interval between the pair of first regions on a center of the upper surface, the pair of first regions provided in a leftward/rightward direction in plane view; and a central region located between the pair of first regions and that includes a central portion of the upper surface in the leftward/rightward direction in plane view, and wherein hardness of the central region is higher than the first hardness.

4. The chair according to claim 1, wherein the cushion has a convex portion that is disposed along an outer edge of the seat plate and that is engaged with the outer edge.

5. A chair comprising a backrest, a seat and legs, wherein the seat includes:

a cushion formed with a structure made of a thermoplastic resin;

a seat plate configured to support the cushion; and an outer covering configured to cover the cushion, and wherein an upper surface of the cushion includes:

a first place that has a first hardness and that is configured to support a sitting person's buttock;

a second place that is located outside of the first place when seen in a plan view and that has a second hardness higher than the first hardness; and a third place that is located outside of the second place when seen in a plan view and that has a third hardness higher than the second hardness, wherein the cushion includes:

a pair of first regions that include the first place positioned having an interval between the pair of first regions on a center of the upper surface in a leftward/rightward direction in plane view; and a central region located between the pair of first regions and that includes a central portion of the upper surface in the leftward/rightward direction in plane view, and wherein hardness of the central region is higher than the first hardness.

* * * * *